US008541706B2

(12) United States Patent
Limbert

(10) Patent No.: US 8,541,706 B2
(45) Date of Patent: Sep. 24, 2013

(54) ELECTRICAL SWITCH

(75) Inventor: Edward Limbert, Manlius, NY (US)

(73) Assignee: Marquardt Mechatronik GmbH, Rietheim-Weilheim (GB)

( * ) Notice: Subject to any disclaimer, the term of this patent is extended or adjusted under 35 U.S.C. 154(b) by 243 days.

(21) Appl. No.: 12/872,185

(22) Filed: Aug. 31, 2010

(65) Prior Publication Data

US 2011/0067987 A1 Mar. 24, 2011

Related U.S. Application Data

(60) Provisional application No. 61/245,311, filed on Sep. 24, 2009.

(51) Int. Cl.
*H01H 19/06* (2006.01)

(52) U.S. Cl.
USPC ..... 200/302.3; 200/339

(58) Field of Classification Search
USPC ..... 200/302.3, 302.2, 339, 553
See application file for complete search history.

(56) References Cited

U.S. PATENT DOCUMENTS

| | | | | |
|---|---|---|---|---|
| 4,946,130 | A * | 8/1990 | Kooiman | 251/95 |
| 4,947,008 | A * | 8/1990 | Sato et al. | 200/6 R |
| 5,008,503 | A * | 4/1991 | Stuhlmacher | 200/308 |
| 6,444,930 | B1 * | 9/2002 | MacDonald et al. | 200/302.3 |
| 6,573,466 | B1 * | 6/2003 | Rapp et al. | 200/302.3 |
| 6,626,473 | B1 * | 9/2003 | Klein et al. | 292/347 |
| 6,677,545 | B2 * | 1/2004 | Kenmochi | 200/314 |
| 7,145,091 | B1 * | 12/2006 | Wang | 200/302.3 |
| 7,282,657 | B2 * | 10/2007 | Wimmer et al. | 200/302.2 |
| 8,050,019 | B2 * | 11/2011 | Wennemer et al. | 361/679.08 |

FOREIGN PATENT DOCUMENTS

| | | | |
|---|---|---|---|
| DE | 18 14 082 | U | 6/1960 |
| DE | 197 05 068 | A1 | 8/1998 |
| DE | 10 2008 034 046 | A1 | 1/2009 |
| EP | 0 122 465 | A2 | 10/1984 |
| WO | 96/08024 | A1 | 3/1996 |

* cited by examiner

*Primary Examiner* — Xuong Chung Trans
(74) *Attorney, Agent, or Firm* — Burr & Brown

(57) ABSTRACT

An electrical switch having a housing, with a contact system being located in the interior of the housing. A movable operating member, in particular in the form of a rocker, is arranged on the housing for switching action on the contact system. An opening is located in the housing, for the switching action of the operating member. An elastic seal for the opening is attached to the housing. The operating member comprises a moving inner part, which is located in the interior of the housing, in particular an inner rocker which can pivot, and a moving outer part, which is located on the exterior of the housing, in particular an outer rocker which can pivot. The seal completely covers the opening. The outer part moves the inner part, via the elastically moving seal, for switching action on the contact system.

17 Claims, 12 Drawing Sheets

ELECTRICAL SWITCH

CROSS REFERENCE TO RELATED APPLICATION

This application claims the benefit under 35 USC §119(e) of U.S. Provisional Application Ser. No. 61/245,311, having a filing date of Sep. 24, 2009, the entirety of which is incorporated herein by reference.

FIELD OF THE INVENTION

The invention relates to an electrical switch.

BACKGROUND OF THE INVENTION

In the case of electrical appliances which are used in severe operating conditions, precautions must be taken to ensure that the electrical switch is protected against damaging influences which may adversely affect its serviceability. For example, such damaging influences may be exposure to moisture, dust or the like. This applies particularly to switches which are used in appliances for building technology, agriculture, building trade, or the like.

One such electrical switch is known from DE 197 05 068 A1. The switch has a housing with a contact system which is located in the interior of the housing. The operating member is in the form of a rocker, which is arranged on the housing such that it can move, and is used for the switching action on the contact system, with an opening being provided in the housing, for the switching action of the operating member. For sealing, the opening is provided with an elastic seal which is attached to the housing.

The contact system of this known switch has a switching contact which is mounted so that it can pivot, and on which the operating member acts by means of a central plunger, for switching. The central plunger is attached to the operating member and projects through the opening into the interior of the switch. The seal, which is attached to the housing and comprises a bellows or an O-ring, also rests on the plunger. However, it has been found that harmful substances, for example water, can migrate into the interior of the housing between the plunger and the seal, and thereby adversely affect the serviceability of the switch.

SUMMARY OF THE INVENTION

The invention is based on the object of further developing an electrical switch such that protection against such ingress of harmful substances into the switch is improved.

In the switch according to the invention, the operating member comprises a moving inner part which is located in the interior of the housing, preferably an inner rocker which can pivot, and a moving outer part, which is located on the exterior of the housing, in particular an outer rocker which also can pivot. As such, the seal completely cover the opening, with the outer part moving the inner part, via the elastically moving seal while providing the switching action on the contact system. Accordingly, the invention provides a switch with improved sealing. Therefore, the invention provides a rocker switch in which an integrated sealing cap is molded on the switch housing, with the outer rocker acting on the upper part of the sealing cap, and with the inner rocker thus being moved by the lower part of the sealing cap such that the inner rocker in turn switches the contact system.

In a further embodiment, the seal may have a dome-like projection. The projection is preferably provided in the form of an elastic bellows. In this case, the projection can be moved elastically with respect to the inner part by the movement of the outer part. Furthermore, a pin on the inner part projects into the opening of the projection such that, during movement of the outer part, the projection acts on the pin in order to move the inner part. An embodiment such as this is distinguished by the improved functional reliability and a longer life of the switch.

In order to simplify production, the seal may be composed of a thermoplastic elastomer, for example polyurethane. The housing is normally composed of a thermoplastic, for example polyamide. In order to reduce the number of individual parts and to simplify the assembly work, it is possible for the seal and the housing to be made in the form of a two-component (2C) part. For this purpose, the seal is molded by injection molding of the housing for the switch using the 2C method onto a housing wall which contains the opening, in particular at the edge of the opening, during the production of the housing wall.

The seal may also be optionally composed of a thermoplastic elastomer which is largely opaque, or at least partially transmissive to visible light. This provides a switch which can be illuminated and, for example, have a function and/or an associated symbol indicator which also can be illuminated, since the thermoplastic elastomer is at least partially transmissive to some visible light. Therefore, in this case, at least one optical waveguide composed of thermoplastic elastomer will pass through the housing wall of the housing in order to allow light which is produced by a light-emitting diode, an incandescent lamp or the like in the housing interior outwards, in order to illuminate the switch. In order to simplify production, the optical waveguide may likewise be molded on, essentially at the same time as the seal, again using the 2C method, during the production of the housing wall.

For good accessibility and assembly of the switch, the housing comprises a housing upper part and a housing lower part. In order to simplify assembly, the housing upper part can be latched, clipped, clamped or the like to the housing lower part during the assembly of the switch. Further, in order to seal the two housing parts, an O-ring may be arranged between the housing lower part and the housing upper part with the O-ring being located in between them. The O-ring may also be a separate part, in a conventional manner. Again, to simplify assembly of the switch, of course, it is possible for the O-ring to be molded onto the housing lower part or onto the housing upper part, or the like.

In one embodiment, the contact system is in the form of a snap-action switching system which can be operated by a switching lever, thus ensuring that the switch is highly reliable.

The inner part then acts during its movement, that is to say in particular the inner rocker during pivoting, by means of an attachment on the switching lever in order to switch the contact system. This allows the contact system to be largely assembled in advance as an assembly, with the contact system being attached to a base member, which is located in the interior of the housing. The electrical connections for the contact system are likewise fixed in the base member. Furthermore, the inner part is mounted on the base member so that it can move or the inner rocker can rotate. The base member is then arranged in the housing such that the connections pass through one wall on the housing lower part while the inner part faces that housing wall of the housing upper part which contains the opening.

In order to protect the seal during operation of the switch, the inner rocker and the outer rocker may have rotation shafts which are arranged in parallel to one another, particularly along the same rotation shaft. For the sake of simplifying the assembly, the rotating bearing for the rotation shaft of the inner rocker is located on the base member, and the rotating bearing for the rotation shaft of the outer rocker is located on the exterior of the housing upper part. Finally, the inner part, particularly the inner rocker, can be latched by means of a ball, which engages in a receptacle on the inner part within the switch position of the contact system, thus providing a switch with latching positions.

The following statements can be made for one particularly preferred embodiment. This embodiment solves two problems, to be precise on the one hand this embodiment has a reliably operating snap-action switching contact system which has a longer life. On the other hand, it has another operating system where a boundary surface is created. This operating member comprises the following components:

an outer rocker which can be operated by the user;

a housing composed of a hard plastic with an integrated elastomer operating knob, in which case the housing and the operating knob can be produced using the two-component injection-molding method; and an inner rocker which operates the contact system.

When the user operates the operating rocker on the one side, this then moves the inner rocker, via the operating knob. Accordingly, the inner rocker carries out a plurality of functions, precisely:

one side of the inner rocker acts on the switching lever of the contact system, with the contact system being switched on;

the inner rocker can be latched in the operated position, as a result of which the switched-on position of the contact system is in the form of a latching position; and the other side of the inner rocker in this case pivots upward, with the other side of the outer rocker in consequence likewise being pivoted upward, and in the process switching off a further contact system.

The advantages achieved by the present invention are, in particular, that a switch with better sealing is created, with the risk of ingress of water or other harmful substances being significantly reduced from entering this switch. Because the seal, the bellows, the operating knob or the like are integrated in the housing, the housing interior of the switch is hermetically sealed from the outside. All that is exerted on the seal, the bellows, the operating knob or the like is the exertion force needed for operation, thus increasing the life of the switch.

BRIEF DESCRIPTION OF THE DRAWINGS

Exemplary embodiments of the invention as well as various developments and refinements will be described in more detail in the following text, and are illustrated in the drawings.

DETAILED DESCRIPTION OF THE INVENTION

Figure 1:
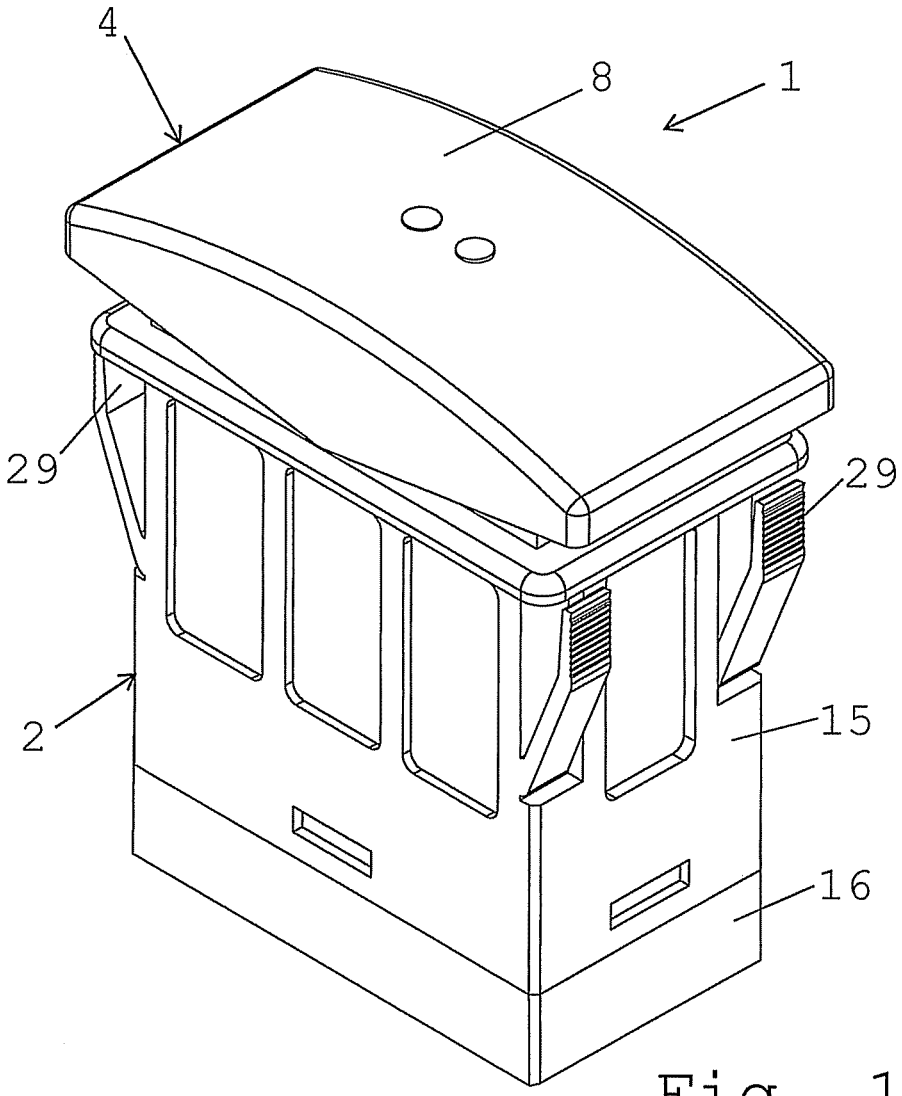
FIG. 1 shows an electrical switch corresponding to a first exemplary embodiment.
Figure 4:
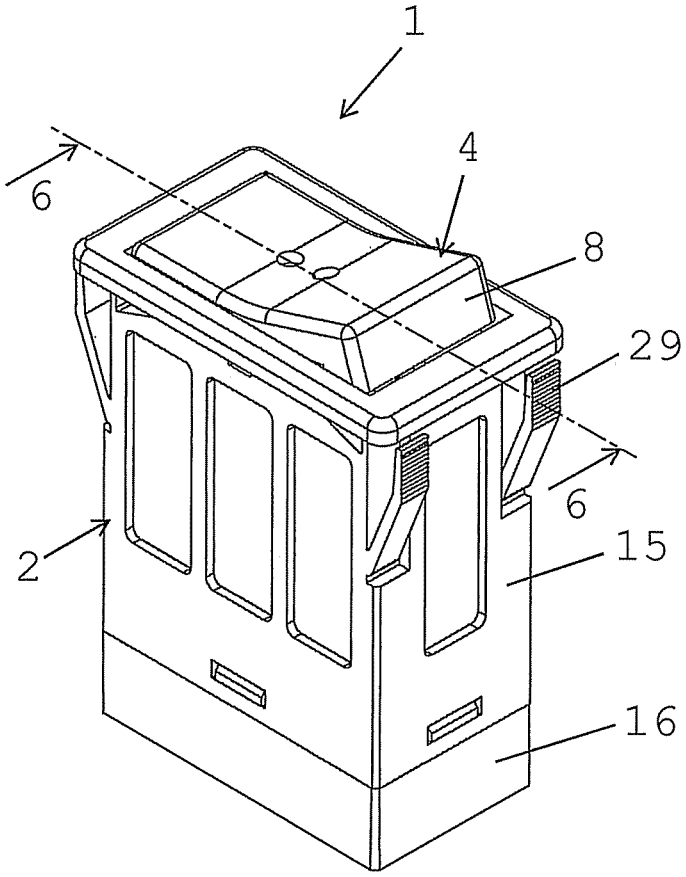
FIG. 4 shows an electrical switch corresponding to a second exemplary embodiment.

FIG. 1 shows an electrical switch 1 with a housing 2. The housing 2 can be inserted by means of latching arms 29 into a receptacle on a panel of an electrical appliance. An operating member 4, which is in the form of a rocker, is arranged on the housing 2 such that it can move, and with the aid of which the user can switch the switch 1 on and/or off. In the case of the switch 1 shown in FIG. 1, the switch is designed such that the operating member 4 is located above the panel. In another embodiment, which can be seen in FIG. 4, the operating member 4 is located below the panel and projects out of the receptacle in the panel, for operation by the user.

Figure 2:
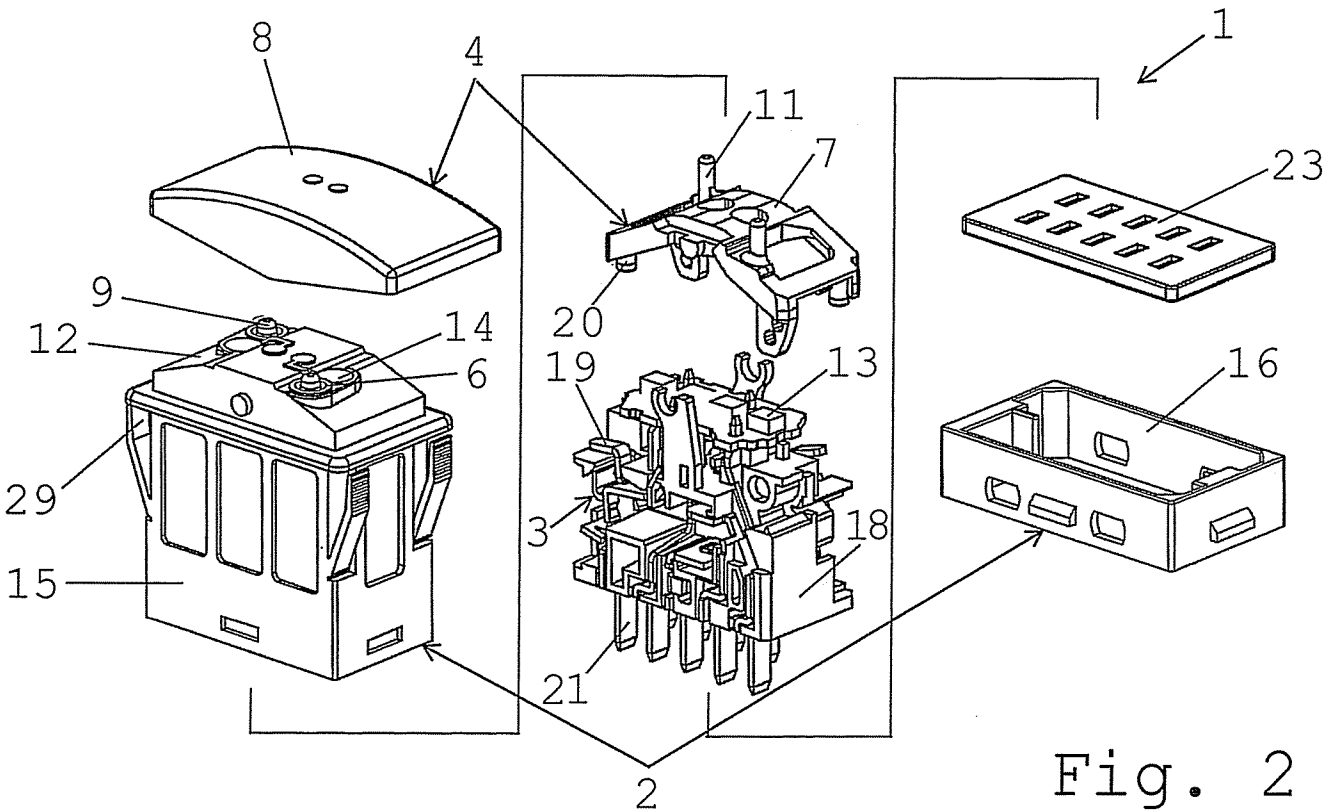
FIG. 2 shows an exploded illustration of the switch shown in FIG. 1.
Figure 6:
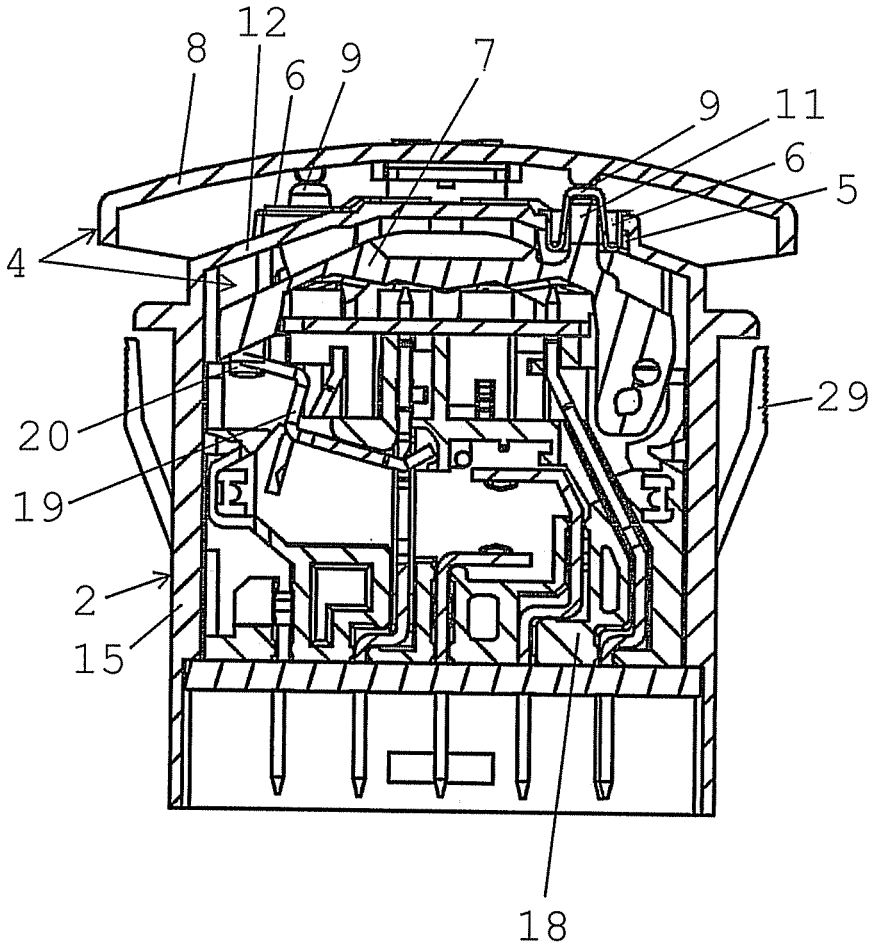
FIG. 6 shows a section along the line 6-6 in FIG. 4, with the operating member being located in the unoperated position.

The individual parts of the switch 1 are shown in more detail in an exploded illustration in FIG. 2. The switch 1 has a contact system 3 which is located in the interior of the housing 2 and which is acted on for switching purposes by the operating member 4, when operated by the user. For the switching action of the operating member 4, an opening 5, which can be seen in FIG. 6, is located in the housing 2. An elastic seal 6 for the opening 5 is attached to the housing 2 in order to prevent the ingress of harmful substances into the interior of the housing 2.

As can also be seen from FIG. 2, the operating member 4 is formed from two parts. For this purpose, the operating member 4 comprises a moving inner part 7, which is located in the interior of the housing 2, and a moving outer part 8, which is located on the exterior of the housing 2. Since the switch 1 is a rocker switch, the inner part 7 is expediently in the form of an inner rocker which can pivot, and the outer part 8 is in consequence in the form of an outer rocker which can pivot. As shown in FIG. 6, the opening 5 is completely covered by the seal 6. As can also be seen with reference to FIG. 7, the outer part 8 moves the inner part 7 via the elastically moving seal 6, when the operating member 4 is operated, for the switching action of the contact system 3.

Figure 5:
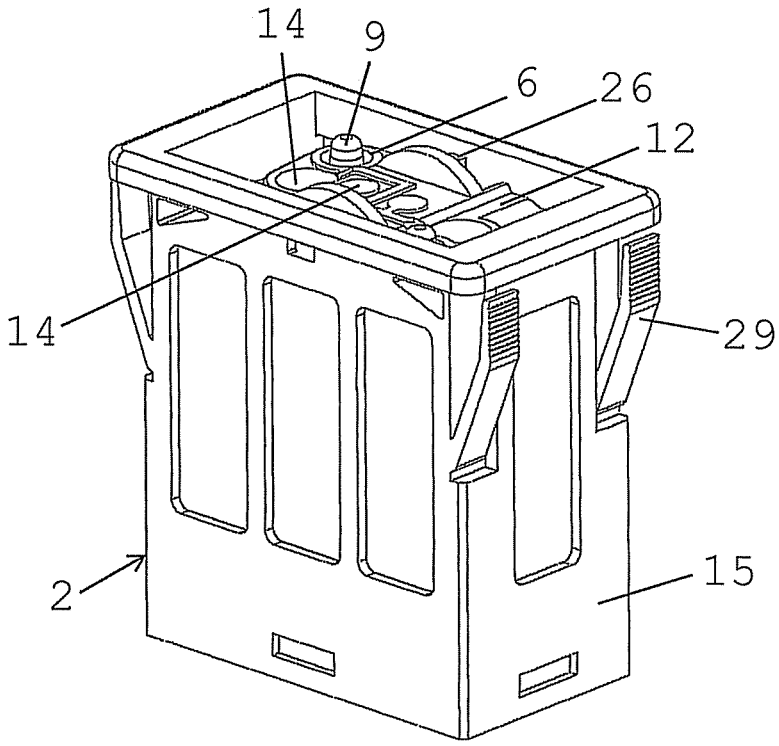
FIG. 5 shows the switch shown in FIG. 4, with the operating member partially removed.
Figure 7:
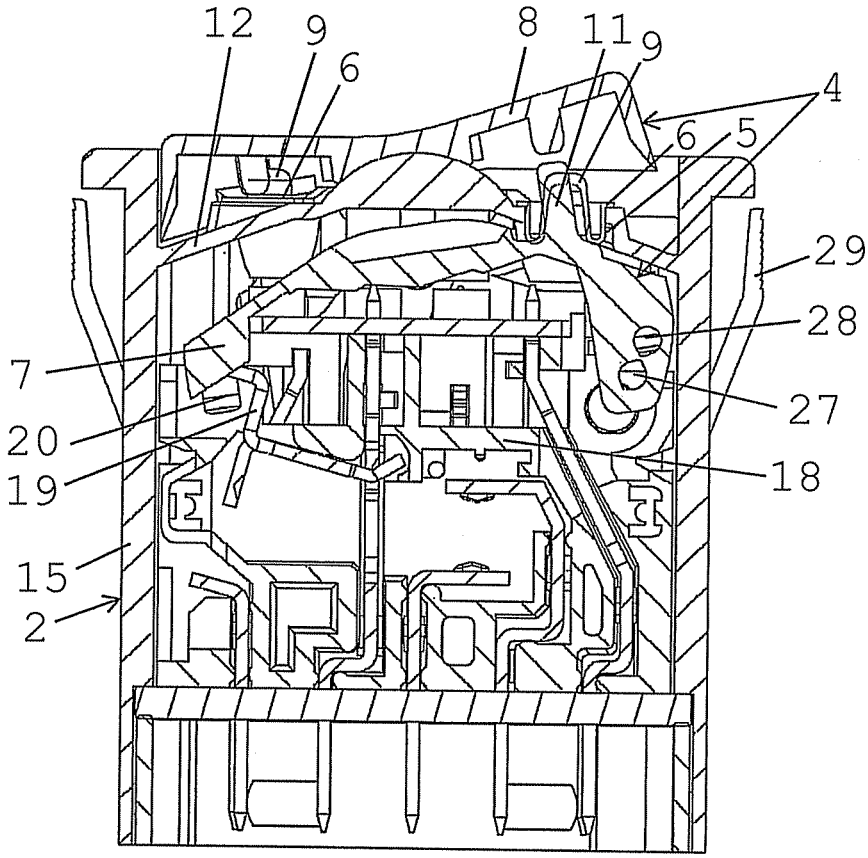
FIG. 7 shows a section as in FIG. 6, but with the operating member being located in an operated position.

The seal 6 has a dome-like projection. In one embodiment, which can be seen in more detail in FIG. 5, the dome-like projection of the seal 6 is in the form of a bellows 9. In another embodiment, the dome-like projection of the seal 6 is in the form of a cupola. These embodiments of the seal 6 make it possible for the dome-like projection of seal 6 (e.g., bellows 9) to be moved elastically with respect to the inner part 7 as a result of the movement of the outer part 8, as can be seen with reference to FIG. 7. As can be seen in FIG. 6 and FIG. 7, a pin 11 on the inner part 7 furthermore projects through the opening 5 into the dome-like projection of seal 6, as a result of which, during movement of the outer part 8, the dome-like projection of seal 6 acts on the pin 11 in order to move the inner part 7.

In order to achieve the required elasticity, the seal 6 is composed of a thermoplastic elastomer which, for example, may be polyurethane or poly(styrene-ethylene-butadiene-styrene). In the conventional manner, the housing 2 is composed of a thermoplastic which, for example, may be polyamide or polypropylene. The housing 2 is preferably produced by injection molding. It is then possible for the seal 6 and the housing 2 to be in the form of a two-component (2C) part, in that the seal 6 is molded by injection molding, using the 2C method, onto a housing wall 12 which contains the opening 5, during the production of the housing wall 12 and of the housing 2. In this case, the seal 6 is molded onto the edge of the opening 5, as can be seen in FIG. 6.

If required, the seal 6 may be composed of a thermoplastic elastomer which is largely opaque, or else is at least partly transmissive to visible light. The opaqueness can be achieved, for example, by appropriate coloring of the raw material for the thermoplastic elastomer. However, if the aim is to design the switch 1 such that it can be illuminated, for example by arranging a light source 13, which comprises a light-emitting diode, in the interior of the housing 2 as shown in FIG. 2, then it is possible for the thermoplastic elastomer to be at least partially transmissive to the visible light. In this case, at least one optical waveguide 14 passes through the housing wall 12 of the housing 2 while being produced from the same thermoplastic elastomer as that of the seal 6. The optical waveguide 14 can then be also molded on, essentially at the same time as the seal 6, using the 2C method in a single process, during the production of the housing wall 12 and of the housing 2.

Figure 3:
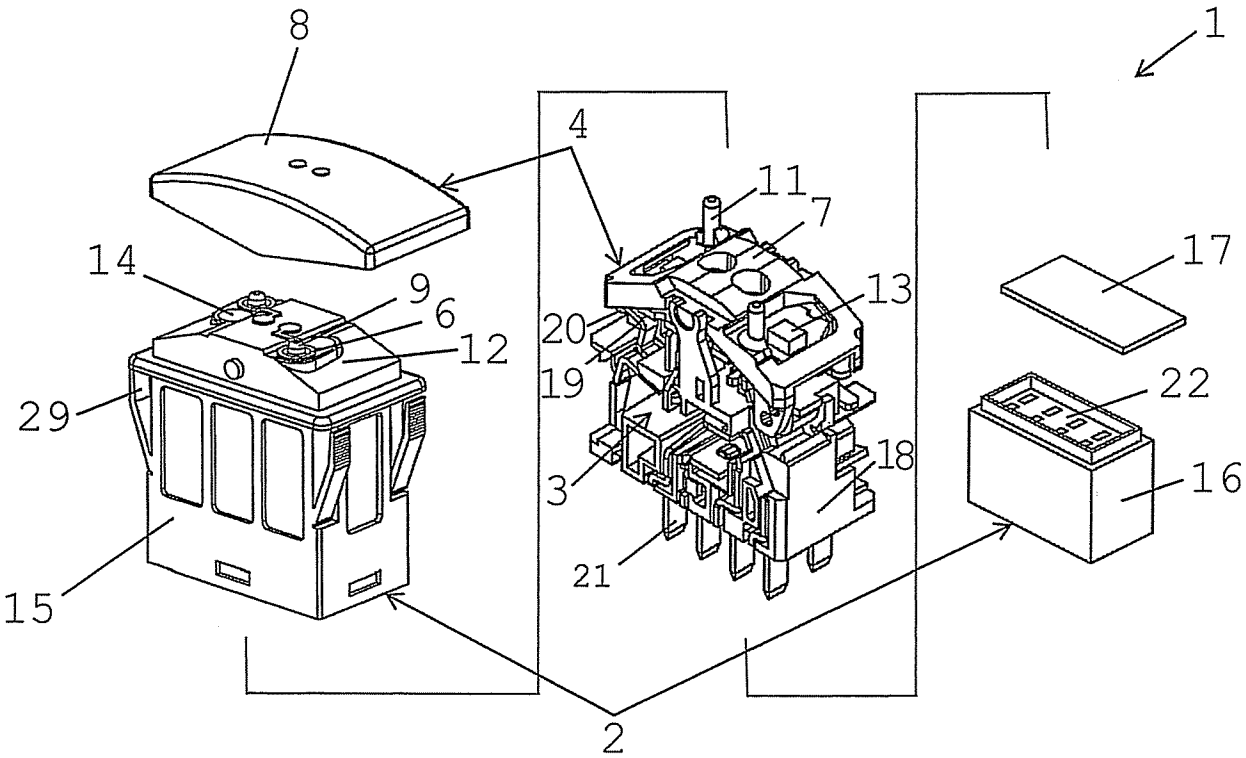
FIG. 3 shows the switch as in FIG. 2, but with a modification in the area of the connections.

As can be seen from FIG. 2 or FIG. 3, the contact system 3 is attached to a base member 18, which is located in the interior of the housing 2. As in the described embodiment, the contact system 3 is in the form of a snap-action switching system, which can be operated by a switching lever 19. The inner part 7 acts during its movement by means of an attachment 20 on the switching lever 19. That is to say in the present case that the inner rocker 7 during pivoting switches the contact system 3. Furthermore, electrical connections 21 for the contact system 3 and for the light sources 13 are fixed in the base member 18. Finally, the inner part 7 is mounted on the base member 18 such that it can move, with the inner rocker 7 being arranged on the base member 18 such that it can also pivot or rotate. The base member 18 can then be completely assembled in advance with these parts, as can be seen in FIG. 11.

Figure 11:
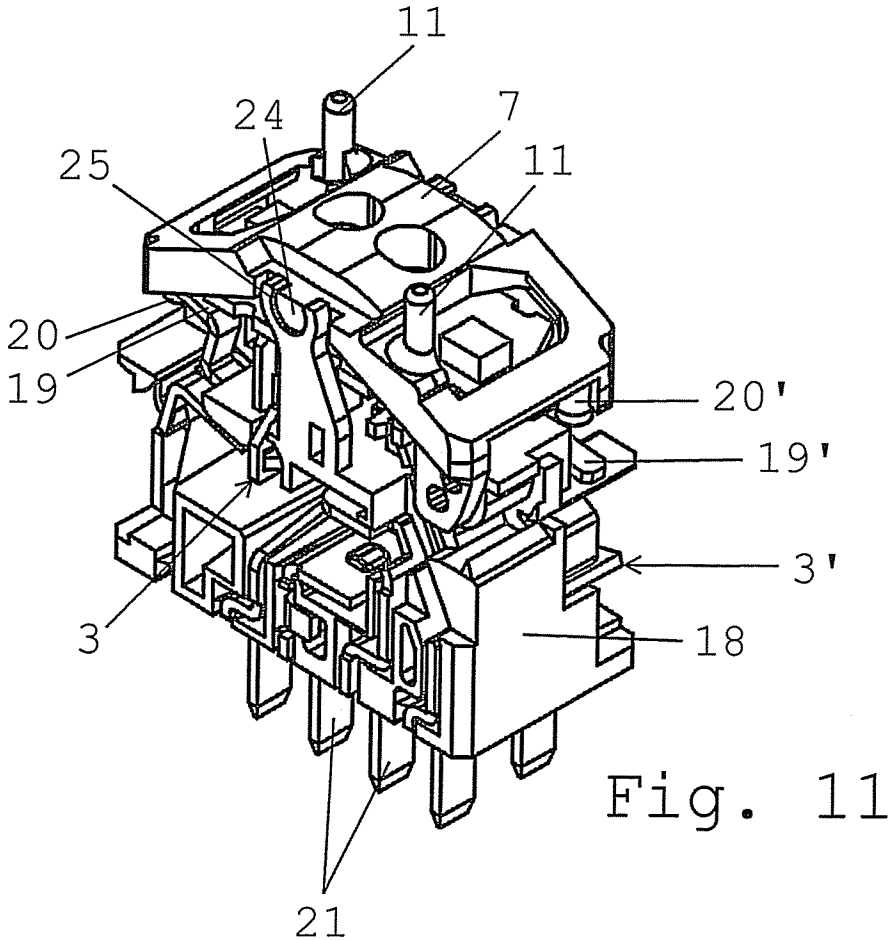
FIG. 11 shows a detail view from FIG. 2, enlarged.

As can also be seen in FIG. 11, a contact system 3' is located in the base member 18 and can be further operated by an attachment 20' on the inner part 7 by means of a switching lever 19'. When the operating member 4 is pivoted in the counter clockwise direction, then the contact system 3 is switched on. When, in contrast, the operating member 4 is pivoted in the clockwise direction, then the contact system 3' is switched on. When the operating member 4 is in the non-pivoted initial position, in contrast, both contact systems 3, 3' are switched off.

As can also be seen from FIG. 3, the housing 2 comprises a housing upper part 15 and a housing lower part 16. During assembly of the switch 1, those parts which are located in the interior of the housing 2, that is to say in particular that base member 18 can be assembled in advance, by being inserted into the housing upper part 15 and/or into the housing lower part 16. In this case, the base member 18 is arranged in the housing 2 such that the connections 21 pass through one wall 22 on the housing lower part 16, with the inner part 7 facing the housing wall 12 of the housing upper part 15 which contains the opening 5. For this purpose, the connections 21 can be pushed through the wall 22, as shown in FIG. 3, with the plastic of the housing lower part 16 being appropriately conditioned during assembly. If necessary, a sealing surface 23, which can be seen in FIG. 2, that is composed of rubber-like material or the like, may also be used instead of the wall 22, so that the connections 21 are pushed through the rubber-like material during assembly. The housing upper part 15 and the housing lower part 16 are then connected to one another. For this purpose, the housing upper part 15 can be latched, clipped, clamped or the like to the housing lower part 16. For sealing, an O-ring 17 can also be arranged between the housing lower part 16 and the housing upper part 15, as shown in FIG. 3, and located between them. The O-ring 17 may be a separate part. A molded sealing part may, of course, also be provided on the housing lower part 16 or on the housing upper part 15, instead of the O-ring 17.

Figure 8:
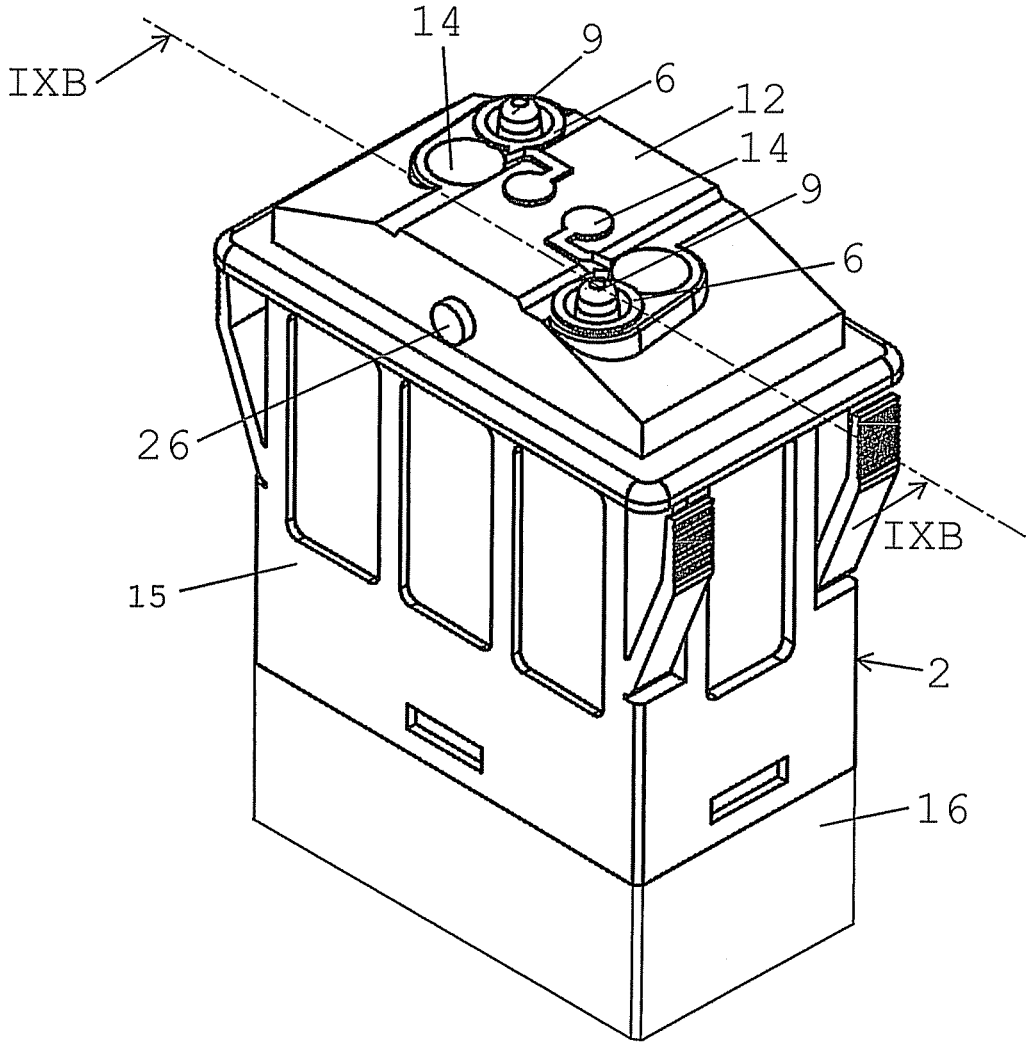
FIG. 8 shows the switch shown in FIG. 4, in a further refinement with the operating member partially removed.
Figure 9A:
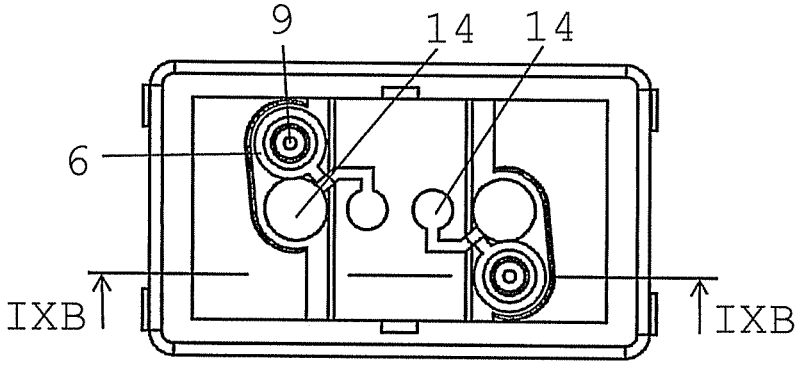
FIG. 9*a* shows a top view of the switch shown in FIG. 8.
Figure 9B:
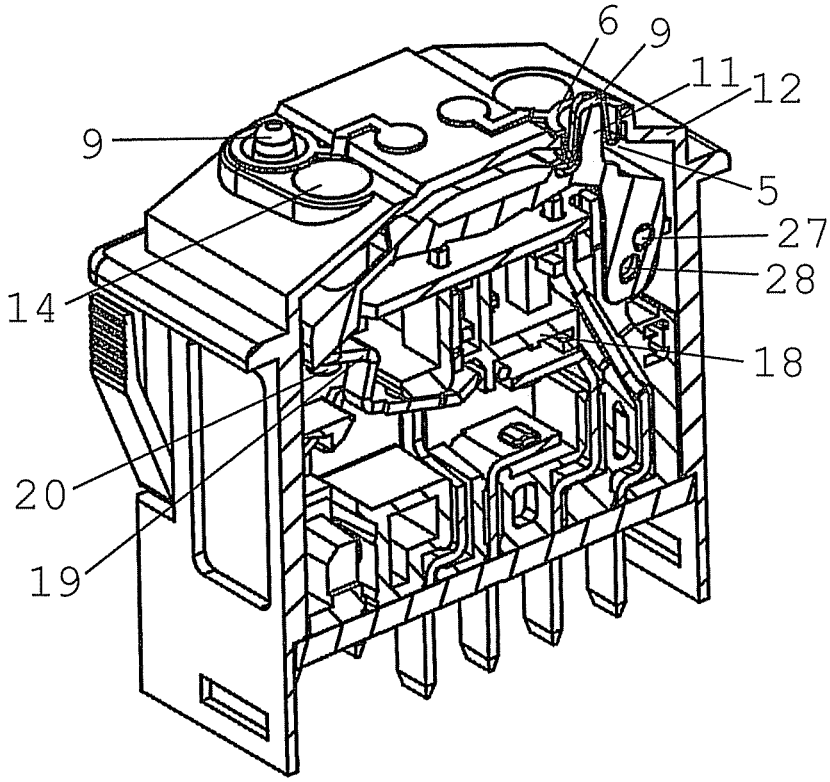
FIG. 9*b* shows a section along the line IXB-IXB in FIG. 8.
Figure 10:
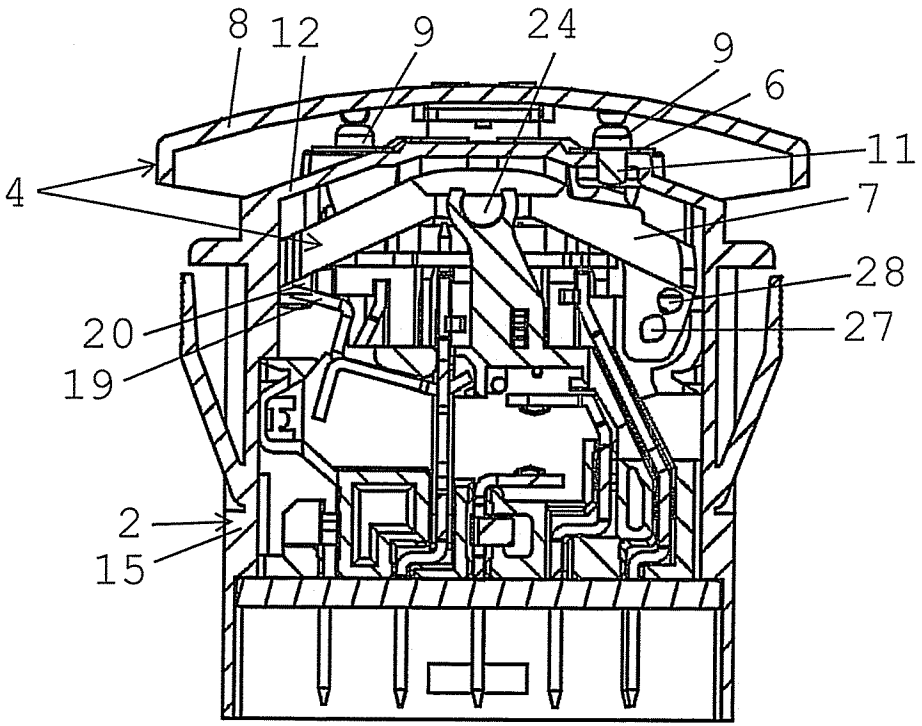
FIG. 10 shows a detail view from FIG. 9*b*, with the operating member complete.

The arrangement and configuration of the operating member 4 can be seen in detail in FIG. 10. The inner part 7 and the outer part 8 have rotation shafts which are arranged parallel to one another, preferably along the same rotation shaft 24. This ensures that the seal 6 is only slightly loaded during operation of the operating member 4, thus increasing its life. The rotating bearing 25 for the rotation shaft 24 of the inner part 7 is also located on the base member 18, as seen in FIG. 11. The rotating bearing 26 for the rotation shaft 24 of the outer part 8 is located on the exterior of the housing upper part 15, as shown in FIG. 8. Finally, the switched-on position of the contact system 3, 3' is in the form of a latching position. Corresponding to FIG. 9*b*, the inner part 7, specifically the inner rocker, can for this purpose be latched by means of a ball 28, which engages in a receptacle 27 on the inner part 7, when the operating member 4 is in the operated position, as shown in FIG. 7. The respective operated position of the operating member 4 in this case corresponds to the switched-on position for the respective contact system 3, 3'.

Figure 12:
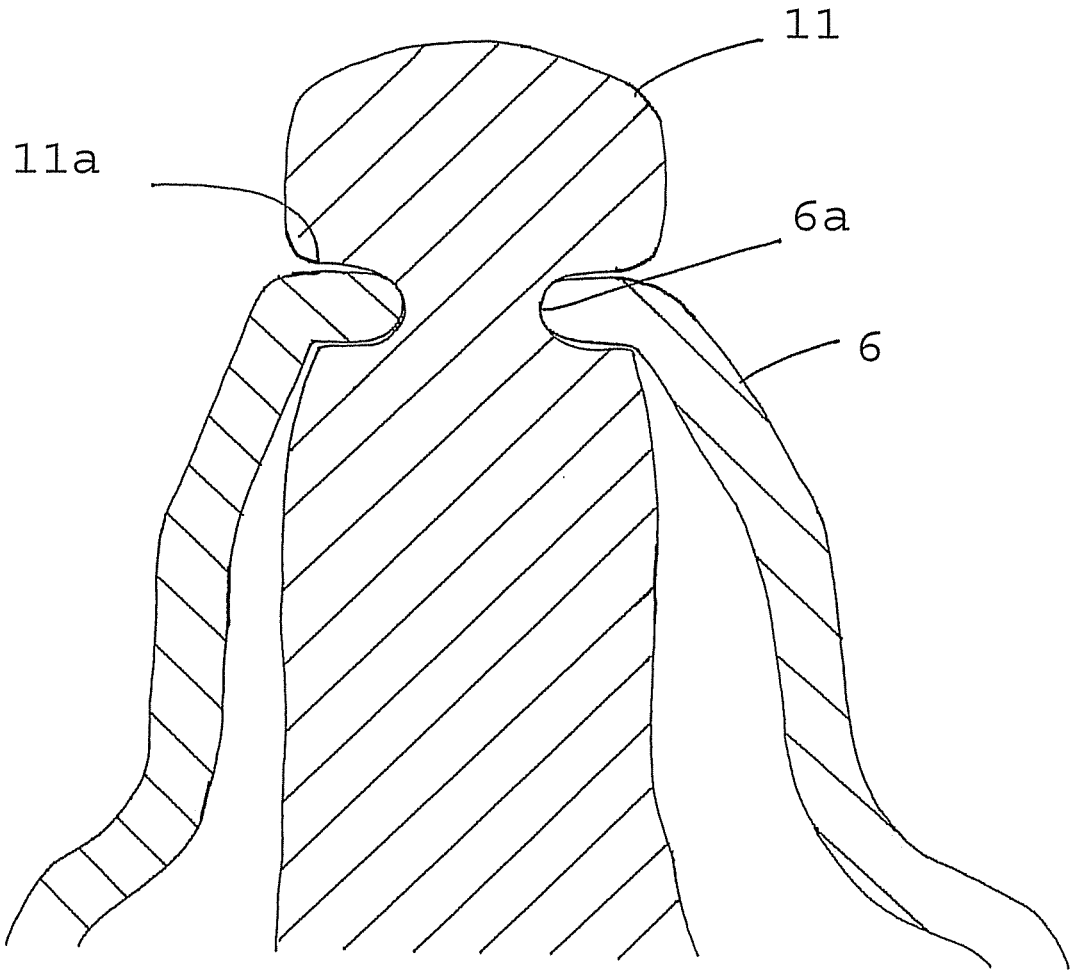
FIG. 12 shows another embodiment where the pin of the inner rocker protrudes through the seal.

FIG. 12 shows another embodiment where the tip end of the pin 11 of the inner part 7 protrudes through a hole 6*a* in the seal 6. The pin 11 includes an annular groove 11*a* that has an inner, lateral dimension that is slightly larger than the diameter of the hole 6*a* through the seal 6. In this way, the seal 6 tightly grips the pin 11 and provides a waterproof and dust-proof barrier.

The embodiment depicted in FIG. 12 is sometimes preferred when the material of the seal 6 cannot necessarily hold up to the abrasion caused by direct contact with the under side of the outer rocker 8. Having the outer rocker 8 contact the pin 11 directly prevents contact between the outer rocker 8 and the seal 6, and thus enhances the longevity of the seal.

The invention is not restricted to just the described and illustrated exemplary embodiments. Further, it also covers all special developments within the scope and intention of the invention as defined by the patent claims. For example, the invention can be used not only on the described rocker switch, but also on push switches, slide switches or other types of similar switches.

LIST OF REFERENCE SYMBOLS

1: Electrical switch
2: Housing
3, 3': Contact system
4: Operating member
5: Opening (in the housing)
6: Seal
6*a*: Hole in seal
7: Inner part/inner rocker
8: Outer part/outer rocker
9: Bellows
11: Pin
11*a*: Annular groove in pin
12: Housing wall
13: Light source
14: Optical waveguide
15: Housing upper part
16: Housing lower part
17: O-ring

18: Base member
19, 19': Switching lever
20, 20': Attachment (on the inner part)
21: (Electrical) connection
22: Wall
23: Sealing surface
24: Rotation shaft
25: Rotating bearing (for inner rocker)
26: Rotating bearing (for outer rocker)
27: Receptacle
28: Ball
29: Latching arm

The invention claimed is:

1. An electrical switch comprising:

a housing having a contact system located in the interior thereof, a moveable operating member arranged on the housing for switching action on the contact system, an opening in the housing for the switching action of the operating member, the housing including an upper wall that contains the opening which is offset from a center of the housing, and an elastic seal attached to the housing for sealing the opening, wherein the operating member has a moving inner part located in the interior of the housing, and a moving outer part located on the exterior of the housing, wherein the seal covers the opening, and wherein the outer part moves the inner part, via the seal, for switching action on the contact system, wherein the seal completely covers the opening in the housing, and wherein the inner part comprises a pin that projects into the opening and movement of the outer part acts on the pin to move the inner part.

2. The electrical switch as claimed in claim 1, wherein the seal has a dome projection that is elastically moveable with respect to the inner part by movement of the outer part, and the pin of the inner part projects into the dome projection.

3. The electrical switch as claimed in claim 2, wherein the seal is in the shape of a bellows.

4. The electrical switch as claimed in claim 1, wherein the seal comprises a thermoplastic elastomer and the housing comprises a thermoplastic.

5. The electrical switch as claimed in claim 4, wherein the seal and the housing are in the form of a two-component (2C) part, in that the seal is molded by injection molding, using the 2C method, onto the housing wall which contains the opening, at the edge of the opening, during the production of the housing wall.

6. The electrical switch as claimed in claim 5, wherein the thermoplastic elastomer is at least partially transmissive for visible light, and said switch further comprises at least one optical waveguide composed of thermoplastic elastomer passing through the wall of the housing, and wherein the optical waveguide is molded on, essentially at the same time as the seal, using the 2C method, during the production of the housing wall.

7. The electrical switch as claimed in claim 4, wherein the seal comprises polyurethane or poly(styrene-ethylene-butadiene-styrene) and the housing comprises polyamide or polypropylene.

8. The electrical switch as claimed in claim 1, wherein the seal comprises a thermoplastic elastomer that is substantially opaque or partially transmissive for visible light.

9. The electrical switch as claimed in claim 1, wherein the housing comprises a housing upper part and a housing lower part, such that the housing upper part can be latched, clipped or clamped to the housing lower part during assembly of the switch, and said switch further comprises a sealing O-ring located between the housing lower part and the housing upper part, wherein the O-ring is in the form of a separate part, a part that is molded onto the housing lower part, or a part that is molded onto the housing upper part.

10. The electrical switch as claimed in claim 9, wherein the contact system is attached to a base member, which is located in the interior of the housing, wherein electrical connections for the contact system are fixed in the base member, wherein the inner part is mounted on the base member such that it can move, and wherein the base member is arranged in the housing such that the connections pass through one wall on the housing lower part, and the inner part faces that housing wall of the housing upper part which contains the opening.

11. The electrical switch as claimed in claim 10, wherein the inner part is an inner rocker and the outer part is an outer rocker, and both have rotation shafts that are arranged parallel to one another, and said switch further comprises a rotating bearing for the inner rocker located on the base member, and a rotating bearing for the outer rocker located on the exterior of the housing upper part.

12. The electrical switch as claimed in claim 11, wherein the inner and outer rockers rotate about the same rotation axis.

13. The electrical switch as claimed in claim 1, wherein the contact system is in the form of a snap-action switching system which can be operated by a switching lever, and wherein the inner part acts during its movement by means of an attachment on the switching lever in order to switch the contact system.

14. The electrical switch as claimed in claim 1, wherein the inner part can be latched by means of a ball that engages in a receptacle on the inner part, in the switch position for the contact system.

15. The electrical switch as claimed in claim 1, wherein the inner part has an annular groove for receiving a portion of the seal to ensure that the seal provides a waterproof and dust-proof barrier.

16. An electrical switch comprising:

a housing having a contact system located in the interior thereof, a moveable operating member arranged on the housing for switching action on the contact system, an opening in the housing for the switching action of the operating member, the housing including an upper wall that contains the opening which is offset from a center of the housing, and an elastic seal attached to the housing for sealing the opening, wherein the operating member has a moving inner part located in the interior of the housing, and a moving outer part located on the exterior of the housing, wherein the seal covers the opening, and wherein the outer part moves the inner part, via the seal, for switching action on the contact system, wherein the seal has a dome projection that is elastically moveable with respect to the inner part by movement of the outer part, wherein the inner part comprises a pin that projects through the opening into the dome projection, and wherein, during movement of the outer part, the projection acts on the pin in order to move the inner part.

17. The electrical switch as claimed in claim 16, wherein the pin projects upward into an opening in the dome projection and is contacted by the moving outer part when the operating member is actuated.

* * * * *

UNITED STATES PATENT AND TRADEMARK OFFICE

CERTIFICATE OF CORRECTION

PATENT NO. : 8,541,706 B2
APPLICATION NO. : 12/872185
DATED : September 24, 2013
INVENTOR(S) : Edward Limbert It is certified that error appears in the above-identified patent and that said Letters Patent is hereby corrected as shown below:

Title page, Item (73) Assignee

Correct: "Marquardt Mechatronic GmbH, Rietheim-Weilheim (GB)" to -- Marquardt Mechatronik GmbH, Rietheim-Weilheim (DE) --

Signed and Sealed this
Seventeenth Day of December, 2013

Margaret A. Focarino

Margaret A. Focarino
*Commissioner for Patents of the United States Patent and Trademark Office*